US009345380B1

(12) United States Patent
Feeny et al.

(10) Patent No.: US 9,345,380 B1
(45) Date of Patent: May 24, 2016

(54) WET MOP

(71) Applicants: John Feeny, Farmington Hills, MI (US); Doug Koester, Troy, MI (US); Grover Nuding, Celina, OH (US)

(72) Inventors: John Feeny, Farmington Hills, MI (US); Doug Koester, Troy, MI (US); Grover Nuding, Celina, OH (US)

(73) Assignee: Tuway American Group, Inc., Troy, MI (US)

( * ) Notice: Subject to any disclaimer, the term of this patent is extended or adjusted under 35 U.S.C. 154(b) by 0 days.

(21) Appl. No.: 14/313,988

(22) Filed: Jun. 24, 2014

Related U.S. Application Data

(63) Continuation of application No. 13/162,414, filed on Jun. 16, 2011, now Pat. No. 8,756,745.

(60) Provisional application No. 61/355,403, filed on Jun. 16, 2010.

(51) Int. Cl.
*A47L 13/12* (2006.01)
*A47L 13/20* (2006.01)

(52) U.S. Cl.
CPC ..... *A47L 13/20* (2013.01)

(58) Field of Classification Search
CPC ..... A47L 13/10; A47L 13/12; A47L 13/20; A47L 13/42; A47L 13/44; A47L 13/46; A47L 13/252; A47L 13/255
USPC ..... 15/146, 147.1, 115, 118, 228, 229.1
See application file for complete search history.

(56) References Cited

U.S. PATENT DOCUMENTS 2,686,328 A * 8/1954 Kirby ..... 15/229.1
4,679,859 A * 7/1987 Wilson ..... 300/21
7,124,464 B2 * 10/2006 Williams et al. ..... 15/115

* cited by examiner

*Primary Examiner* — Shay Karls
(74) *Attorney, Agent, or Firm* — Young Basile Hanlon & MacFarlane P.C.; Denise M. Glassmeyer

(57) ABSTRACT

A mop device composed of a handle, a mop head configured to connect to the handle and a mop strand bundle connected to the mop head. The mop strand bundle is composed of a plurality of strand members disposed in parallel relation to one another and connected to one another in at least one location. The mop strand bundle also includes a head band. The head band is positioned at a location between first and second ends of the mop strands other than medial between the first and second ends of the strand bundle. The mop head engages the mop strand bundle at a location defined by the head band.

13 Claims, 4 Drawing Sheets

WET MOP

BACKGROUND

The present invention is a continuation of U.S. Ser. No. 13/162,414 filed Jun. 16, 2011 currently pending which claims priority to U.S. Ser. No. 61/355,403 filed Jun. 16, 2010, the specification of which are incorporated by reference herein.

The present invention relates in general to wet mops which include, but are not limited to cut-end or looped end mops.

Various wet mops have been proposed as tools for cleaning operations. Cleaning speed and efficiency is limited to the size and wet weight ratio that can be employed during mopping operations. Typically mop stroke surface cleaning area is limited because of the maximum wet weight that can be safely and efficiently manipulated.

Wet mops also can have some drawbacks with regard to cleaning efficiency. Conventional mop heads lack the cleaning surface structure necessary to address certain stains and deposits. There are some instances in which conventionally configured wet mops have difficulty removing stains and crusted material present on floor surfaces. In order to remove such materials, the operator must typically employ a separate scrubbing implement. This adds time to the scrubbing exercise An additional drawback associated with conventional wet mops can occur depending upon the surfaces to be cleaned. Floor surfaces are generally that uneven. The floor surfaces have small indentations and irregularities in which dirt and grime can reside. Conventional wet mops tend to glide over such indentations and irregularities. Conversely various scrubbing brushes, while more effective at dislodging embedded and encrusted material, do not always remove the material previously dislodged from the floor surface. Material that is scrubbed up from the surface is not effectively contained in the scrub brush and transferred to wash fluid or the like.

Thus it would be desirable to provide a wet mop that could be employed effectively to scrub and mop various floor surfaces. It is also desirable to provide a wet mop that is lightweight and provides significant cleaning efficiency

SUMMARY

Disclosed herein is a mop device composed of a handle, a mop head configured to connect to the mop head. The mop strand bundle is composed of a plurality of strand members disposed in parallel relation to one another. The mop strand bundle is composed of a plurality of strand members disposed in parallel relation to one another and connected to one another in at least one location. The mop strand bundle also includes a head band. The head band is positioned at a location between first and second ends of the mop strands other than medial between the first and second ends of the strand bundle. The mop head engages the mop strand bundle at a location defined by the head band

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
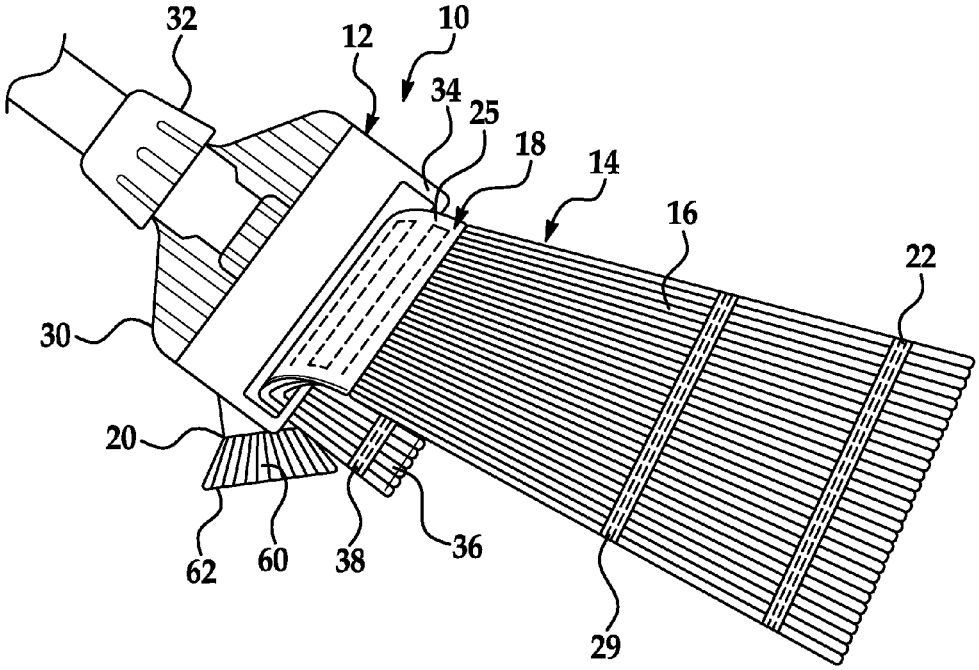
FIG. 1 is a detail perspective view of an embodiment of a mop device of the present invention.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The wet mop device disclosed herein broadly includes a handle, a mop head configured to connect to the handle and a strand bundle composed of a plurality of strand members that are disposed in parallel relation to one another. The strand bundle has a first end and an opposed second end. The respective parallel strands are maintained in fixed relation to one another by a head band that is located at a position between the first end and the second end of the strands. The head band position is proximate to either the first end or the second end.

The strand members can be made of any suitable material. Typically the materials of choice will possess suitable water absorbency. Non-limiting examples of materials include various yams, cloth tabs and the like. The strand members can be bundled together by suitable bundling means. In various embodiments such as those disclosed herein, the various yams are stitched together such that the various yams are positioned in side-by-side with stitching extending in generally crosswise relationship over the various yams. The stitching can be employed in addition to the head band and/or can be integral the attachment of the headband.

In strands, when in position in the strand bundle can be layered relative to one another and can have lengths and widths as the strand bundle and associated mop is typically manufactured and sold by weight designation. Provisions for specific lengths and widths are assumed to be flexible and can vary based on yam diameter and weight. The strand bundle also includes a head band connected to the strand members at a point proximate to the fixed location, such that the head band is positioned at a location other than medial to the string members.

The string bundle can be composed of looped-end strands, however a cut-end version is also included in this description. A conventionally designed string looped-end mop or cut-end mop portion is recognized as a mop element formed from a plurality of yarms with a headband and tailband. The string bundle employed in the embodiment disclosed herein will have an offsetting headband location that is not centered on the strands. This allows for more surface area of the mop to be used on the floor while reducing the overall weight of the mop.

The device 10 described in this disclosure is composed of a handle 11 connected to a suitable mop head 12. Connection between handle and mop head can either be permanent or detachable. It is contemplated that the handle 11 can be composed of suitable metal, plastic or wood as desired or required.

The mop head 12 can be composed of a suitable plastic or metal material. The mop head 12 will be configured to engage the strand bundle 14. Various configurations of the mop head 12 are disused in this disclosure. In various embodiments depicted, the mop head is configured to releasably contact and engage the strand bundle 14. While releasable engagement is depicted in the various drawing figures, it is contemplated that the wet mop 10 disclosed herein can have the strand bundle permanently attached to the handle 12 as by means of the associated mop head.

In the use configuration, the mop head 12 is connected to a suitable string bundle 14. The handle 12 can be of any suitable configuration. As broadly construed the mop head 12 can also have any suitable configuration. In various embodiments depicted herein the mop head 12 can be configured to be releasably attached to the handle 12. Connection can be by any suitable attachment means including but not limited to mating threaded screws, clamps and the like. It is also within the purview of this disclosure that the mop head 12 will be integrally formed the handle as desired or required. The mop portion or strand bundle 14 is composed of a plurality of individual elongated yams or strands 16 that are oriented lengthwise in an essentially parallel orientation.

The individual yams or strands 16 may be positioned in a plurality of layers in various embodiments in order to provide thickness and enhance utility of the strand bundle 14. Thus multiple layers of yams positioned side by side can be integrated in to a strand bundle 14. The individual yams or strands 16 can be attached to each other to form a unit by employing suitable attachment mechanisms. In various embodiments the yams or strands 16 can be stitched to one another to form an attachment means that is essentially perpendicular to the orientation of the elongated individual yams or strands 16. The attachment means will be one that permits the various individual yams or strands 16 to function as a unit while permitting the various yams and strands 16 individual movement relative to one another. Non-limiting examples of attachment means include direct stitching (not shown) and/or connection or affixing of a suitable headband 18. Where desired or required, the strand bundle 14 can employ both.

In the embodiments depicted, the wet mop device 10 includes a headband 18. The headband 18 can be of any suitable band width, unit width and thickness. Band width W of headband 18 is measured along a plane generally perpendicular to that length of the string bundle 14 defined by the longitudinal plane coplanar with the elongated yams or strands when the yams strands 16 are oriented in their parallel elongated positions. Unit width UW of the string bundle 14 is defined as the width of the headband 18 as extending from side end 20 to side end 20 of the strand bundle 14. Thickness T of the headband 18 is the measurement of the headband material from interior side edge 21 to opposed interior edge 21'. The band width W of the headband 18 will be that value sufficient to provide that strand coverage at a desired wet weight. In certain various embodiments, the head band 18 has a band width W that can vary from less than 1" to 8" or greater. The thickness T of headband 18 can be any value that provides a sufficient contact surface as will be described in greater detail subsequently. In certain embodiments, the thickness T headband 18 can be equal to the width W. In other embodiments, it is contemplated that the thickness T will be with him 50% of the value of bandwidth W.

The headband 18 can be composed of various materials. However the primary material will be a 100% polyester material that has been sized for increased stiffness and strength. Non-limiting examples of suitable material include the various polymeric open-weave mesh materials that can provide flexibility and conform to the surface of the strand fibers 16. The headband material is present in overlying relationship to the strand fibers 16. Capital I it can be maintained in position relative to the strand fibers by any suitable attachment. Why all it he zooms and other attachment mechanisms are considered within the purview of this disclosure, it is contemplated that the attachment can be by suitable over stitching 23 that extends from an upper surface 25 to a lower surface (not shown). In the embodiment depicted the stitching 23 is present in a serpentine pattern with the various individual roles of stitching progressing transversely from side 22 opposed side 20'. Other configurations are also considered within the purview of this disclosure.

Figure 4:
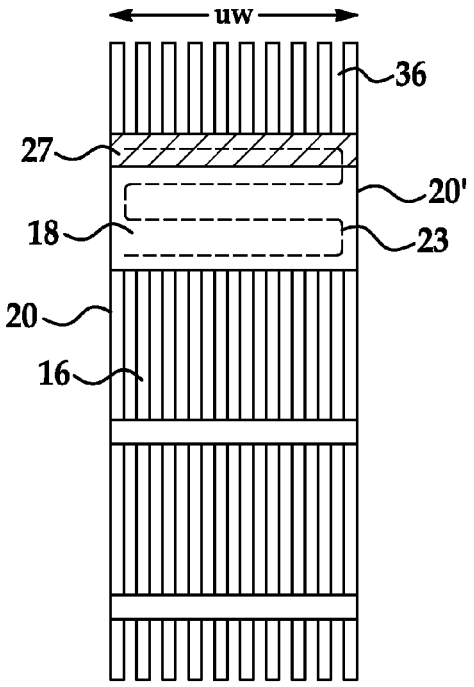
Figure 5:
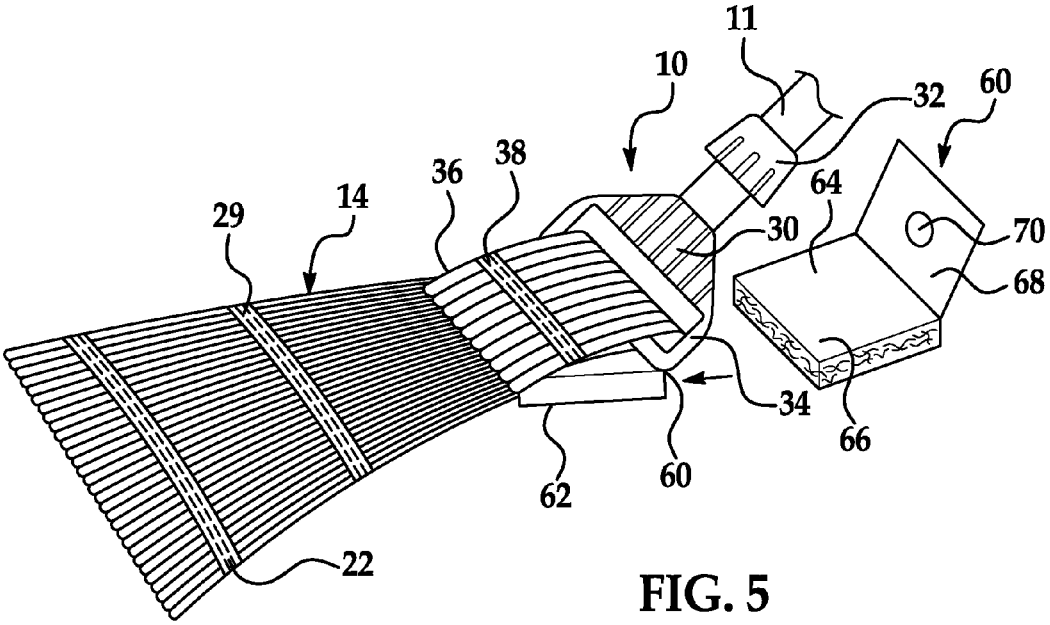
FIG. 5 is a detail perspective view pf an alternate embodiment of the mop device of the present invention.

The headband 18 can also include a suitable edge marker 27 as depicted in FIG. 4. The edge marker 27 can be integral to the headband material or can be added as a separate member. In certain embodiments it is contemplated that the edge marker will be a suitable tape or ribbon that is joined to the headband 18 and associated strand bundle 14. The edge marker 27 can be composed of a material of a contrasting color or have other visible indicia means incorporated thereon. The edge marker 28 can provide the operator with the visible orientation mechanisms as desired or required.

While a single edge marker 27 has been disclosed in the drawing figures, it is within the purview of this disclosure to include other headband indicia as desired or required. Non-limiting examples of headband indicia could include brand marking, orientation instructions etc.

Where desired or required, the strand bundle 14 can include additional body bands such as tail band 22. Tail band 22 will be located proximate to an outer edge of the strand bundle. The tail band 22 will generally have a thickness T that is less than the thickness T of headband 18. The width W of tail band 22 will typically be equal to or greater than the width of headband 18. In the embodiment depicted in the various drawing figures, the tail band has a width W equals two or slightly greater than the width W of headband 18. It is also contemplated that the width the W of tail band 22 can be up to four times greater than the width W of headband 18, with widths between 2 W and 3 W being suitable in some applications. The tail band 22 can be made from various blends of materials; however the preferred material will be a 100% polyester material. The tail band 22 can be attached to the strand bundle 14 by any suitable means or mechanism. In various embodiments such as that depicted in FIG. 1, the tail band 22 is attached to the strand bundle 14 by suitable stitching that passes through the upper surface of the tail and the cheerio through the various strands 16 in strand bundle 14 two hold the yarns securely in place. The various strands 16 are typically engaged in an edge to edge fashion.

Figure 3:
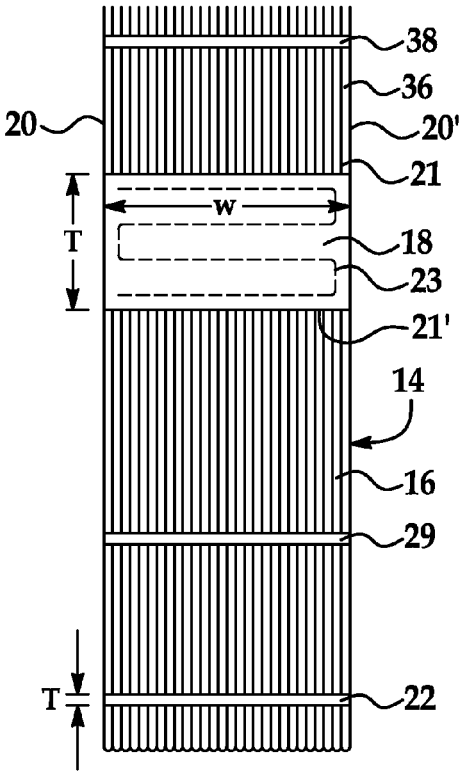
FIGS. 3-4 are plan views of an alternate embodiment of a strand bundle that can be employed in an alternate embodiment of the present invention;.

The strand bundle 14 of wet mop device 10 may include a single tail band 22 if desired or required. In certain embodiments, however, the strand bundle 14 of wet mop device 10 may also include an intermediate band 29 located at a spaced distance between headband 18 and tail band 22. Intermediate band 29 can have a width W equal to the width W of headband 18 (as illustrated in FIGS. 3 and 4). It is also contemplated that the intermediate band 29 can have a width that is greater than headband 18 but less than tail band 22. In certain embodiments, the headband 18 will have a width W, the tail band 22 will have a width of approximately 3 W and the intermediate band will have a width of approximately 2 W.

The tail band 22 and intermediate band 29 can have any suitable thickness T. The thickness of tail band 22 and intermediate band 29 will be significantly less than that of headband 18. Where desired or required, tail band 22 and intermediate band 29 can have equal thicknesses. Tail band 22 and intermediate band 29 can be positioned on the strand bundle 14 at locations that will provide and permit movement of the individual strands 16 relative to one another. In various embodiments, the tail band will be located proximate to an edge region of the strand bundle. The location will be such that a fringe of either looped strands or cut strands extends outward from the tail bands 22. The intermediate band 29 will typically be located at a position medial between the headband 18 and the tail band 29 such that the associated strand bundle 14 can flex and move relative to the associated mop head 12.

The strand bundle 14 of mop device 10 as disclosed herein can be composed from any suitable absorbent material configured as woven strands, yarn material and the like. The materials of choice will be absorbent, wringable and may be capable of reuse as desired or required. Thus the yarn or strand material 16 can be washable by suitable industrial washing techniques. Some examples of suitable material include but are not limited too yarn materials such as 100% cotton, various cotton/synthetic blend mixes, 100% synthetic blend, 100% microfiber or a microfiber blend yarn material. It is contemplated that in applications where the yarn or strand material 16 of strand bundle 14 is washable and reusable, the materials employed in the tail band 22, intermediate band 29 and headband 18 will also be reusable and washable.

It is also contemplated that the wet mop device 10 can be composed of one or more components that are biodegradable. In certain embodiments, it is contemplated that devices such as those disclosed herein will be designed such that each individual component which makes up the threaded bundle 14 of the mop device is determined to be biodegradable when processed in a composting environment. Biodegradable components can include headband material that is biodegradable when placed in composting environment. The tail band 22 and/or intermediate band 29 also can employ materials that are biodegradable when placed in a composting environment. The thread material used for stitch-fastening the strand bundle 14 can also be biodegradable material when placed in a composting environment. It is also contemplated that any printed labels associated with the strand bundle 14 to provide part number or private label information can employ an earth friendly inks printed onto a label material that will dissolve when placed in a chemical or in a composting environment. The yarn or strand material can be specially blended yarn material where the fibers of the yarn material will breakdown in a composting.

In the embodiments depicted in the drawing figures, the tail band 22 and intermediate band 29 are disclosed to be straight cross-sectional members. It is also within the purview of this disclosure that one or more of the tail band 22 and/or intermediate band 29 can be configured in and X configuration, as well as V and W configurations if desired or required. While stitched bonding is discussed in conjunction with the embodiment disclosed in the drawing figures, it is also contemplated that one or more of the bands can be glued or heat bonded to achieve attachment.

The strand bundle 14 is configured such that the headband 18 is located proximate to one and of the collected strands 16. Thus the strand bundle 14 is divided into a larger strand region that can include tail band 22 and intermediate band 29. The strand bundle 14 also includes a region having headband 18 and a smaller fringe region 36 located opposite the larger strand region. The fringe region will have a width equal to or greater than the width W of headband 18 and can be composed of either looped strands or cut strands of the fiber material. Where desired or required the fringe region 36 can also include a band member 38 attached to and connecting the various individual strands 16. In situations where the width of the fringe region 36 is greater than the headband region 18, the various loops in the fringe region 36 can form a fluted or pleated configuration relative to one another. In such situations, the band member 38 can assist in maintaining the fluting or undulation in the fringe region 36. The longitudinal thickness of the fringe region 36 will be equal to or less than the thickness T of the associated headband 18 in certain embodiments.

The unique design of the wet mop device 10 as disclosed herein has been found to allow for more contact points between the yam material of the associated strand bundle 14 and the floor surface area to be cleaned. The increased contact points allow for more fluid absorption and/or release. The result can be more fluid absorbed from the floor surface and/or chemicals and fluids can be released onto the floor surface to improve clean-ability and/or soil load pick- up. The unique design also reduces manual labor time as the operator would not be required to return to an associated bucket and wringer containing waster and/or cleaning chemicals as frequently as would be required with a conventional mop of standard conventional industry design of the same weight.

The strand bundle 14 can be employed with mop heads 12 of various configurations. The mop head 12 associated with the wet mop device 10 of the present invention will be one that is configured to contact and maintain the strand bundle 14 and an operative position relative to handle 11. The mop head 12 contacts the strand bundle 14 at the headband 18 such that the larger portion of strand bundle 14 projects outward from the mop head 12 and associated handle 11.

As broadly construed, mop head 12 according to certain embodiments, will include a suitable body 30 having means 32 for connecting the mop head 14 to the handle 11. A non-limiting example of such connection means is mating threaded surfaces on the end of handle 11 configured to be received in a suitably mating orifice defined in the mop head body 30. Other connection means 32 are also contemplated. Other non-limiting examples will be discussed subsequently.

The body 30 of mop head 12 also includes suitable means 34 for positioning the strand bundle 14 in the mop head 12. In the embodiment depicted in FIG. 1, the strand bundle 14 connecting means can be configured as a suitable compressible clasp. Various non-limiting examples of other connection mechanisms are presented in drawing FIGS. 6 through 12.

Figure 6:
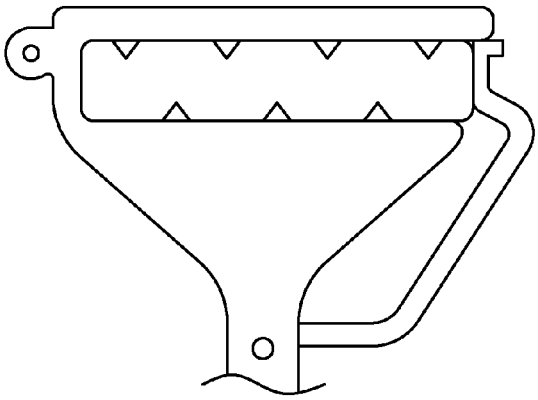
FIG. 6 is an alternate embodiment of a mop head as disclosed herein depicting a plastic clamp configuration.
Figure 7:
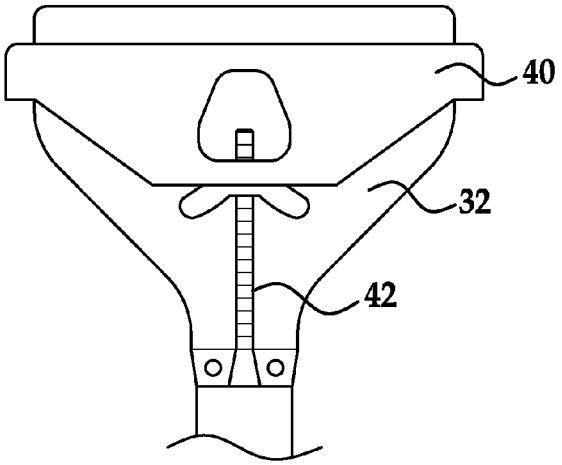
FIG. 7 is an alternate embodiment of a mop head as disclosed herein depicting a screw clamp configuration.
Figure 8A:
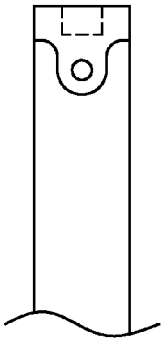
FIG. 8A and 8B is an alternate embodiment of a mop head as disclosed herein depicting a screw type configuration.
Figure 8B:
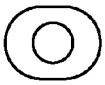
Figure 9:
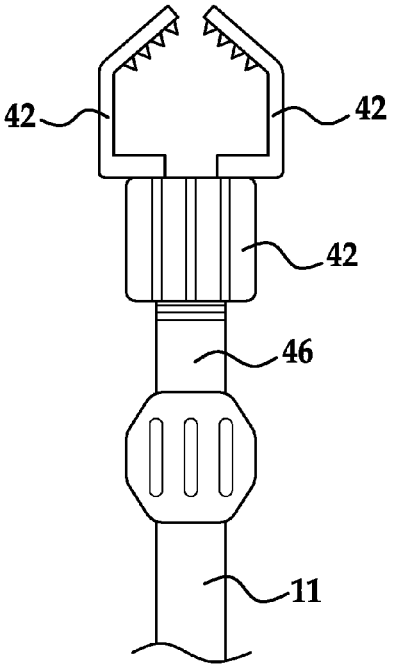
FIG. 9 is an alternate embodiment of a mop head as disclosed herein depicting a jaw type configuration.
Figure 10:
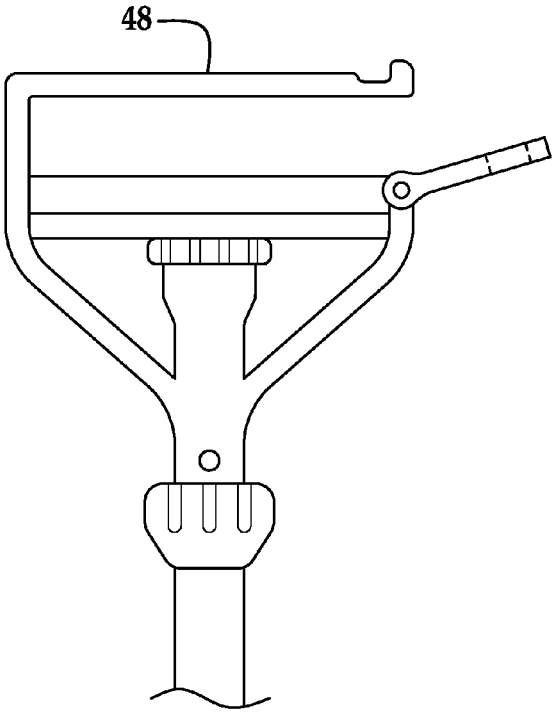
FIG. 10 is an alternate embodiment of a mop head as disclosed herein depicting a side load configuration.
Figure 11:
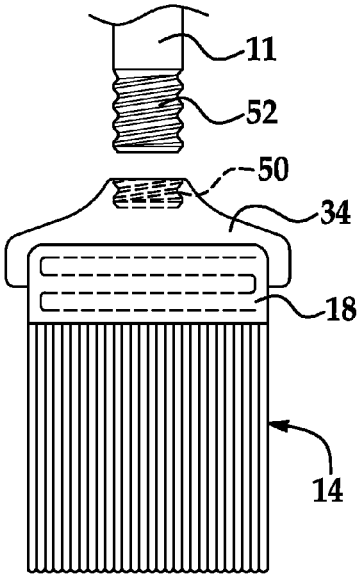
FIG. 11 is an alternate embodiment of a mop head as disclosed herein depicting a plastic screw top mop connector configuration.
Figure 12:
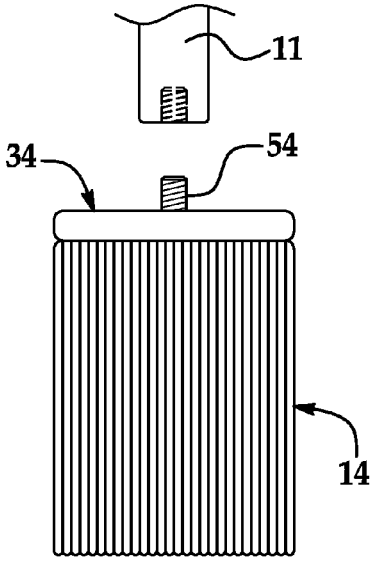
FIG. 12 is an alternate embodiment of a mop head as disclosed herein depicting a threaded connector configuration.

The class mechanism depicted in FIG. 6 is a grabber style mechanism having a hinged member with articulated key that can be drawn into engaging contact with the associated headband. In many applications, this type of mop head 12 is plastic. The device of FIG. 7 is a special quick change mop head having a movable compressible member 40 that is maintained in compressive engagement with the associated mop head 18 by means of a screw mechanism such as a screw 42. The device in FIG. 9 is an articulated jaw type mop head in which the respective jaws 42 are compressed by the rotating action of member 44 relative to the handle 11 and associated mounting device 46. FIG. 10 is directed to a mop head having a clasp member 48 such members are typically referred it to as side loading mop heads. FIG. 11 is directed to a mop head 34 having an interiorly threaded 50 configured to engage a threaded region 52 in handle 11. The headband portion of the threaded bundle 14 engages a suitable region of the associated mop head 34. FIG. 12 is directed to a mop head 12 configured such that the strand bundle 14 is mounted on a suitably threaded post member 54. The threaded member 54 extends through the headband 18 and in gauges an interiorly threaded region on a suitable handle 11. It is also considered to be within the purview of this present disclosure that the strand bundle 14 be permanently mounted relative to the mop head 12.

Figure 2:
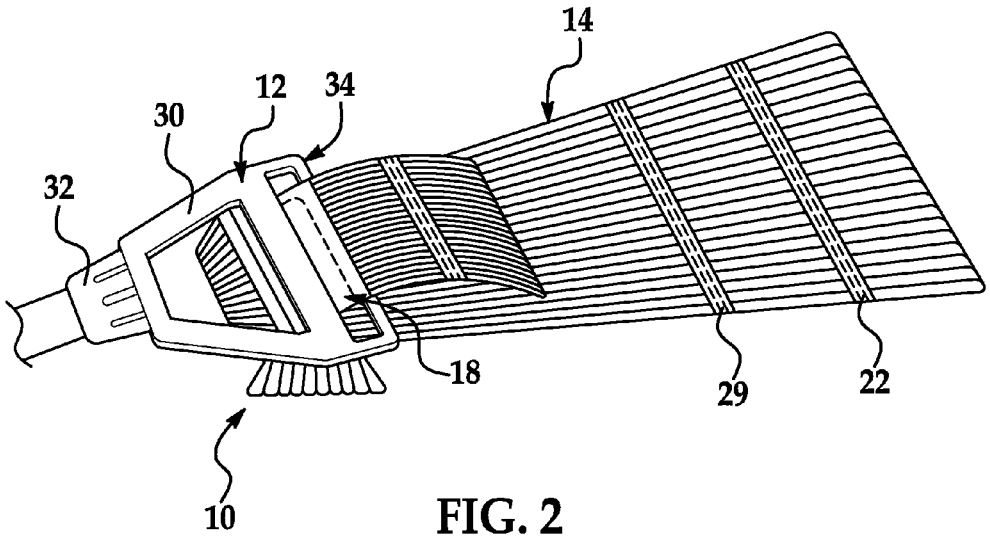
FIG. 2 a detail perspective view of the device of FIG. 1.

The mop head 12 may also be configured with at least one scrubbing member 60 operatively mounted to the mop head 12 and oriented proximate to the strand bundle 14. The scrubbing member 60 can be configured with a suitable agitation surface 62 that includes at least one region of abrasion configured to engage and remove surface dirt adhering to the floor. In various embodiments, the agitation surface 62 is provided as a brush, pad sponge or the like. The scrubbing member 60 can be affixed to the mop head 12 in either permanent or releasable relationship. In the embodiment depicted in FIGS. 1 and 2, the scrubbing member 60 is mounted to a suitable flange 64 that can be configured to attach to the mop head in either a permanent or releasable arrangement. In the embodiment depicted in FIGS. 1 and two, the flange 64 of scrubbing member 60 has a first lateral surface 66 and an angular wing 68 projecting therefrom. The angular wing 68 can be configured with a suitable orifice 70 configured to receive handle 11 or an appropriate member of mop head 12 to facilitate attachment to the associated mop head 12.

The scrubbing member 60 is mounted at an orientation on to the mop head 12 at a location distal to the handle member connection point such that pressure exerted on the handle 11 is transferred to the scrubbing member 60 as desired or required. The scrubbing member 60 can be either permanently mounted to the flange 64 or can be configured to be removable and replaceable. It is also contemplated that the scrubbing member and associated flange 64 may be configured to be removable and replaceable if desired or required.

In the in-use scrubbing position, the strand bundle 14 overlies the scrubbing member 60 and can trail behind it as depicted in the various drawing figures. Strand bundle 14 is mounted in mop head well such that the headband 18 is doubled over itself. Thus the region proximate to the scrubbing member 60 experiences the combined weight of the upper fringe member 36 and the longer strand of region. This provides continual downward pressure on the scrubbing member 60 enhancing cleaning action of that element. The strand bundle 14 is oriented such that the shorter or fringe portion 38 of the strand bundle 14 rests in overlying relationship relative to the scrubbing member 60 providing localized weight on the scrubbing surface 64 and continued downward pressure without extensive additional weight for the unit 10 or additional downward pressure from the operator.

Additionally, the trailing orientation of the threaded bundle 14, when in use in the scrubbing mode permits increased opportunity to collect debris, dirt and cleaning material dislodged by the scrubbing member 60. The scrubbing member 60 can have any suitable size and/or clement. In certain embodiments, the scrubbing member 60 may be configured to have a width essentially equal to the width W of the headband 11.

Without being bound to any theory, it is believed that the unique placement of the headband 11 relative to the strand bundle 14 permits for mop yarn material to come into contact with the cleaning surface than is possible with conventional mops. The headband position is flexible from the center of the mop to the outer most portion of the mop in order to create a varying degree of additional mopping surface. This configuration permits effective use with strand bundles 14 that include either looped and or cut style yarns or strands. The configuration permits effective use with or without the tail band feature.

The short fringe area 38 opposed the longer cleaning looped-end side can function as a protection buffer from the connecting hardware assisting in minimizing contact of the hardware to the cleaning surface. This looped fringe area 38 acts as a buffer between the two elements with certain types of mop handle hardware. The short fringe area 38 also prevents mop strands 16 from becoming entangled underneath the scrubbing member 60 when mopping. It is also been discovered that the orientation of the scrubbing member 60 relative to the short fringe area 38 and the longer region of the strand bundle 14 produces a wet mop which can be moved across a floor surface with greater ease than previously accomplished with conventionally configured wet mop devices. Without being bound to any theory, it is believed that the characteristic surface of the scrubbing member 60 actually produces a lubricous movement effect. The scrubbing member 60 slides across the floor surface during conventional mopping motions thus permitting the strand members 16 present in the strand bundle 14 to move with greater ease.

Additionally the mop head 12 and strand bundle 14 as disclosed presents a unique weight distribution in which a portion of the weight is localized above the scrubbing member 60 while the remainder of the weight of the strand bundle is distributed over the floor to be cleaned. This added weight induces additional preloaded force of the scrubbing member 60 onto the floor surface increasing the agitation process when in use.

The design of this mop is intended to be used floor cleaning operations involving various aqueous cleaning compounds either alone in combination with floor cleaning chemicals, including but not limited to sanitizers, disinfectants and cleaners. The materials can be those having a pH levels between 0 and 7 for certain floor cleaning chemical compositions (acidic based materials) and pH levels between 7 and 14 for caustic floor cleaners.

This wet mop 10 disclosed herein is also intended to be used in combination with floor finishing chemicals, allowing for a larger floor finish application area with a lighter weight mop head 12 and strand bundle 14 combination in contrast to the same typical area of coverage with a standard conventional mops. Additionally, the mop/pad can be used in combination with a straight mop handle of various materials or can be used with an ergonomic style handle in various combination styles.

It is contemplated that the wet mop 10 as disclosed herein will be configured into various standard wringer/bucket configurations as can be found in the market. The wet mop 10 as disclosed herein requires less effort to place the mop head/strands into the wringer for soil/fluid release when depressed by the wringing lever. It is also intended to be easier to remove once such soil/fluid is released due to its lighter weight.

It is been down quite unexpectedly that the wringing process provides the wet mop 10 as disclosed herein with approximately the same amount of fluid contained in the strand bundle 14 as is found in conventional wet mops. Without being bound to any theory is believed that the wet mop 10 as disclosed herein is exposed to additional, more efficient compression of the strands that removes additional access water more easily than with conventional wet mops.

It is contemplated that the wet mop 10 as disclosed herein will be configured into various standard wringer/bucket configurations as can be found in the market. The wet mop 10 as disclosed herein requires less effort to place the mop head/strands into the wringer for soil/fluid release when depressed by the wringing lever. It is also intended to be easier to remove once such soil/fluid is released due to its lighter weight.

Thus the wet mop as disclosed herein can cover the same approximate cleaning area of a larger size wet mop with reduced weight and a more efficient design over the standard mop configuration. The outcome is a reduction in exertion in lifting and lateral movement, while maintaining the same mopping floor surface contact area as well as more efficient cleaning action.

The invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A mop device comprising:

an elongated handle having a longitudinal axis;

a mop head configured to connect to the handle, the mop head having an elongated body oriented perpendicular to the longitudinal axis of the handle when connected to the handle; and a mop strand bundle having a use position, the strand bundle connected to the elongated body of the mop head on an axis perpendicular to the elongated axis of the handle, the mop strand bundle having a first end and an second end the mop strand bundle having a plurality of individual strands oriented in parallel relationship to one another and connected to one another in at least one location, the mop strand bundle further having a head band having a width, the head band connected to the strand bundle such that the strands extend out from first and second edges of the headband, wherein the head band is positioned folded relationship such that the strands extending from the first edge overlie the strands extending from the second edge when the strand bundle is in the use position, and wherein the head band is positioned at an offset location between the first and second ends of the mop strand bundle.

2. The mop device of claim 1 wherein the head band is in attached connection to the individual strands such that distance between the head band and the first end of the strand bundle is less than the second end of strand bundle.

3. The mop device of claim 2 wherein the mop strand bundle further comprises at least one tail band positioned proximate to the second end.

4. The mop device of claim 2 further wherein the strand bundle has a fringe region proximate to the first end of the strand bundle and an elongated region proximate to the second end of the strand bundle.

5. The mop device of claim 4 wherein the mop head comprises a central body, a handle connector attached to the central body at a first location and a headband engaging member defined in the central body opposed to the first location.

6. The mop device of claim 5 wherein the headband is in angular bent relationship about the headband engaging member defined in the central body such that the fringe region of the strand bundle is in contact with the elongated region of the strand bundle and wherein the strand bundle extends outward from the mop head.

7. The mop device of claim 6 further comprising at least one scrubbing member affixed to the mop head, the scrubbing member oriented at an angle greater than 90° relative to the handle member.

8. The mop device of claim 7 wherein the scrubbing member is at least one of porous sponge, bristle member brush, and/or abrasive pad.

9. The mop device of claim 8 wherein the strand bundle is in essentially parallel relationship with the scrubbing member and wherein the mop device can be rotated between a first orientation wherein the strand bundle is interposed between a floor surface and the scrubbing member and a second use position where the scrubbing member is interposed between the floor surface and the strand bundle.

10. A mop device comprising:

an elongated handle having a longitudinal axis;

a mop strand bundle connected to the mop device, the mop strand bundle having a first end and an second end, the mop strand bundle having a plurality of individual strands oriented in parallel relationship to one another and connected to one another in at least one location, the mop strand bundle further having a head band connected to and overlying the strands at the connection location, the head band positioned at an offset location between the first and second ends of the mop strand bundle, the strand bundle has a fringe region proximate to the first end of the strand bundle and an elongated region proximate to the second end of the strand bundle, wherein the headband is in folded relationship when the mop strand bundle is in a use position and wherein the fringe region overlies the elongated region in the use position;

a mop head having an elongated central body, a handle connector attached to the elongated central body at a first location and a headband engaging member defined in the central body at a second location wherein the headband of the strand bundle is engaged in the headband engaging member in an essentially linear manner; and at least one scrubbing member affixed to the mop device, wherein the fringe section and the elongated section overlie the at least one scrubbing member when the scrubbing member is oriented in a use position in contact with a support surface.

11. The mop device of claim 10 wherein the scrubbing member is at least one of porous sponge, bristle member brush, and/or abrasive pad.

12. The mop device of claim 10 wherein the strand bundle is in essentially parallel relationship with the scrubbing member and wherein the mop device can be rotated between a first orientation wherein the strand bundle is interposed between a floor surface and the scrubbing member and a second use position where the scrubbing member is interposed between the floor surface and the strand bundle.

13. The mop device of claim 10 further comprising at least one tail band positioned proximate to the second end of the strand bundle, wherein the headband of the mop strand bundle has a headband width and a tail member has a tail member width, where the tale member width is greater than the headband width.

* * * * *